US006684796B1

(12) United States Patent
Feldermann

(10) Patent No.: US 6,684,796 B1
(45) Date of Patent: Feb. 3, 2004

(54) PARTICULATE INJECTION BURNER

(75) Inventor: Christian J. Feldermann, Sheffield (GB)

(73) Assignee: The BOC Group, plc, Windlesham (GB)

( * ) Notice: Subject to any disclaimer, the term of this patent is extended or adjusted under 35 U.S.C. 154(b) by 0 days.

(21) Appl. No.: 09/053,112

(22) Filed: Apr. 1, 1998

(30) Foreign Application Priority Data

Apr. 25, 1997 (GB) ..... 9708543

(51) Int. Cl.[7] ..... F23C 1/10; F23D 1/00; F23D 5/00; F23B 7/00

(52) U.S. Cl. ..... 110/347; 110/104 B; 110/261; 431/8; 431/10; 431/200; 373/23

(58) Field of Search ..... 110/260, 261, 110/262, 104 B, 263, 264, 265, 266, 347; 431/154, 168, 200, 8, 10; 373/22, 23; 219/121.36, 121.44

(56) References Cited

U.S. PATENT DOCUMENTS

| | | | | | |
|---|---|---|---|---|---|
| 3,112,988 | A | * | 12/1963 | Coldren et al. | 431/8 |
| 3,203,769 | A | * | 8/1965 | Sogawa et al. | 431/8 X |
| 3,266,552 | A | * | 8/1966 | Denis | 431/8 X |
| 4,195,779 | A | * | 4/1980 | Auclair et al. | 431/8 X |
| 4,274,587 | A | * | 6/1981 | Cioffi et al. | 239/132.3 |
| 4,858,538 | A | * | 8/1989 | Kuypers et al. | 110/263 X |
| 4,865,542 | A | * | 9/1989 | Hasenack et al. | 110/263 X |
| 4,928,605 | A | * | 5/1990 | Suwa et al. | 110/261 |
| 5,129,333 | A | | 7/1992 | Frederick et al. | |
| 5,257,926 | A | * | 11/1993 | Drimer et al. | 431/154 |
| 5,451,160 | A | * | 9/1995 | Becker | 431/8 X |
| 5,605,103 | A | * | 2/1997 | LaRue | 110/262 |
| 5,649,494 | A | * | 7/1997 | Hufton | 110/262 |
| 5,685,242 | A | * | 11/1997 | Narato et al. | 110/262 |
| 5,697,306 | A | * | 12/1997 | LaRue et al. | 110/261 |
| 5,724,901 | A | * | 3/1998 | Guy et al. | 110/346 |
| 5,762,486 | A | * | 6/1998 | Leger | 431/8 |
| 5,765,488 | A | * | 6/1998 | Vatsky | 110/261 |
| 5,813,847 | A | * | 9/1998 | Eroglu et al. | 431/8 |
| 5,829,369 | A | * | 11/1998 | Sivy et al. | 110/347 |
| 6,196,142 | B1 | * | 3/2001 | Ohlsen | 110/262 X |
| 6,244,854 | B1 | | 6/2001 | Satchell et al. | |
| 6,360,677 | B1 | * | 3/2002 | Robillard et al. | 110/262 X |

FOREIGN PATENT DOCUMENTS

| | | | | | |
|---|---|---|---|---|---|
| AU | 18637 | | * | 3/1930 | 110/262 |
| DE | 19 10 450 | | | 3/1969 | |
| DE | 271 556 | A1 | * | 9/1989 | 110/261 |
| EP | 0 616 170 | A1 | * | 9/1994 | 110/260 |
| EP | 0 509 581 | B1 | | 6/1995 | |
| GB | 193859 | | * | 5/1924 | 110/262 |
| GB | 218701 | | * | 7/1924 | 110/262 |
| GB | 301851 | | * | 12/1928 | 110/262 |
| JP | 55-165414 | | * | 12/1980 | 110/262 |
| SU | 1386799 | A1 | * | 4/1988 | 431/8 |
| SU | 1751623 | A1 | * | 7/1992 | 431/8 |
| WO | 89/0205 | | * | 3/1989 | 431/8 |
| WO | 96/06954 | | | 3/1996 | |

* cited by examiner

*Primary Examiner*—Ljiljana Ciric
(74) *Attorney, Agent, or Firm*—Joshua L. Cohen

(57) ABSTRACT

A burner has a body portion and a main outlet. Fuel and primary oxidant outlets are arranged upstream of the main outlet and are disposed substantially concentrically about the axis of the burner. A chamber inside the body portion provides a place for the mixing of the fuel and oxidant. A laval nozzle provides acceleration of the mixed fuel and oxidant. Particulate matter are injected into a secondary oxidant flow immediately adjacent and downstream of the accelerating nozzle. The burner can be used in an electric arc furnace for decarburization of metals as well as post combustion. The burner can be mounted in a water-cooled box and can be fitted with an oxygen port for extra oxygen for post combustion while the burner injects hot oxygen and carbon for slag forming.

13 Claims, 5 Drawing Sheets

PARTICULATE INJECTION BURNER

BACKGROUND OF THE INVENTION

The present invention relates to a burner for injecting, such as particulate material, material and relates particularly, but not exclusively, to such a burner for use in an electric arc furnace.

It is well known to provide an electric arc furnace with supplementary oxygen injection lances; operation of such a furnace involves the striking of an arc between electrodes which creates a heating current which passes through the metal to be melted and the injection of supplementary oxygen via the oxygen injection lances, which may be moved closer to or away from the metal as and when desired. Once struck, the arc acts to heat the metal towards its final temperature of about 1620° C. to about 1700° C. whilst the oxygen acts to oxidize undesirable elements in the metal and causes them to be extracted from the metal and generate an insulating slag layer which floats on the surface of the molten metal. The insulating slag layer acts to protect the electrodes and furnace wall from splattering molten metal. Supplementary oxy/fuel burners are often provided in the furnace wall for assisting the electric arc heating effect. Our European patent application number 0764815 A describes an oxy/fuel burner intended to reduce the problem whereby such burners are unable to penetrate the slag layer adequately during the final and critical heating step in conventional electric arc furnaces.

A further problem with conventional electric arc furnaces occurs when it is necessary to introduce particulate material into the furnace in order to assist in the thermal and/or chemical processes occurring therein. It is difficult to ensure that such particulate material is correctly distributed and/or delivered to the correct region of the furnace.

SUMMARY OF THE INVENTION

It is an object of the present invention to reduce and possibly eliminate the above-mentioned problems associated with the introduction of particulate material into furnaces, such as electric arc furnaces.

Accordingly, the present invention provides a burner for use in an electric arc furnace comprising a body portion having a longitudinal axis X and a main outlet located thereon, fuel and primary oxidant outlets upstream of said main outlet and disposed substantially concentrically about axis X, a chamber within the body portion for receiving and mixing said fuel and oxidant and acceleration means downstream of said chamber for causing said mixture of fuel and oxidant to be accelerated towards and out of said main outlet for combustion, wherein means are provided for discharging particulate matter entrained in a secondary oxidant into the flow of accelerated fuel and primary oxidant immediately adjacent and downstream of said accelerating means.

With such an arrangement the oxidant-entrained particulate matter is drawn into the accelerating flow of fuel and primary oxidant to be thoroughly distributed and/or to reach the desired location within the furnace. Where the particulate matter is coal, partial or even total devolatilization can be achieved in the flame, the volatiles providing further fuel for combustion and hence providing fuel savings.

The means for accelerating the flow of fuel and primary oxidant preferably comprises a flow path for the mixture which successively converges and diverges in the direction of flow.

The accelerating means may comprise a Laval nozzle substantially coaxial with axis X, the discharging means being disposed substantially concentrically about axis X. Preferably the discharging means are configured so as to discharge the oxidant-entrained particulate matter substantially parallel to the axis X.

The discharging means may conveniently be in the form of an annulus surrounding the accelerating means, being adapted to discharge the oxidant-entrained particulate matter in a hollow, substantially cylindrical or conical, spray pattern. With such an arrangement, the discharge means may be configured so as to provide a linear flow path for the particulate matter (i.e. a flow path which is substantially parallel along the significant portion of its length) which is particularly suitable when the particulate material is one with significant abrasive qualities, such as iron carbide.

Alternatively, the discharge means may be substantially coaxial with the axis X, the accelerating means being concentrically disposed around the discharge means. The accelerating means may suitably have an outlet in the form of an annular surrounding the discharge means.

In such an arrangement, the acceleration of the fuel and primary oxidant from an annular outlet produces a significant pressure reduction adjacent the discharge means and therefore provides enhanced mixing and penetration of the particulate material. The discharge means may also be shaped and configured so as to accelerate the oxidant-entrained particulate matter discharged therefrom, thereby accelerating the particulate material to an even greater extent.

The present invention also affords a method of operation of a burner for an electric arc furnace, the method comprising accelerating a mixture of fuel and primary oxidant towards and out of a main outlet of a burner body for combustion, and discharging particulate matter entrained in a secondary oxidant adjacent to accelerating flow of fuel and primary oxidant, whereby said oxidant-entrained particulate matter is drawn into the flow of fuel and primary oxidant.

In most electric arc furnace applications the fuel would be natural gas. The primary oxidant may be oxygen or oxygen enriched air and the secondary oxidant for entraining the particulate material is preferably air, although it could be identical to the primary oxidant in some applications. Moreover, although the present invention is described above in relation to the injection of particulate material, we have discovered that certain embodiments of burners in accordance with this invention are particularly suitable for the injection of liquids (such as additional liquid fuel or cryogenic liquids such as liquid oxygen, as may be desirable in certain applications) or for the injection of slurries (i.e. particulate materials entrained in a liquid), as in the drying and/or incineration of waste sludge, such as sewage. In either case, the liquid material is entrained in air, as with the injection of particulate material, but in droplet or atomized form. Accordingly where used herein, and particularly in the claims, the term "particulate material" should be understood to encompass both discrete droplets of liquid and of particulate material entrained in liquid.

BRIEF DESCRIPTION OF THE DRAWINGS

Embodiments in accordance with the invention will now be described by way of example and with reference to the accompanying drawings, in which.

DETAILED DESCRIPTION OF THE INVENTION

Figure 1:
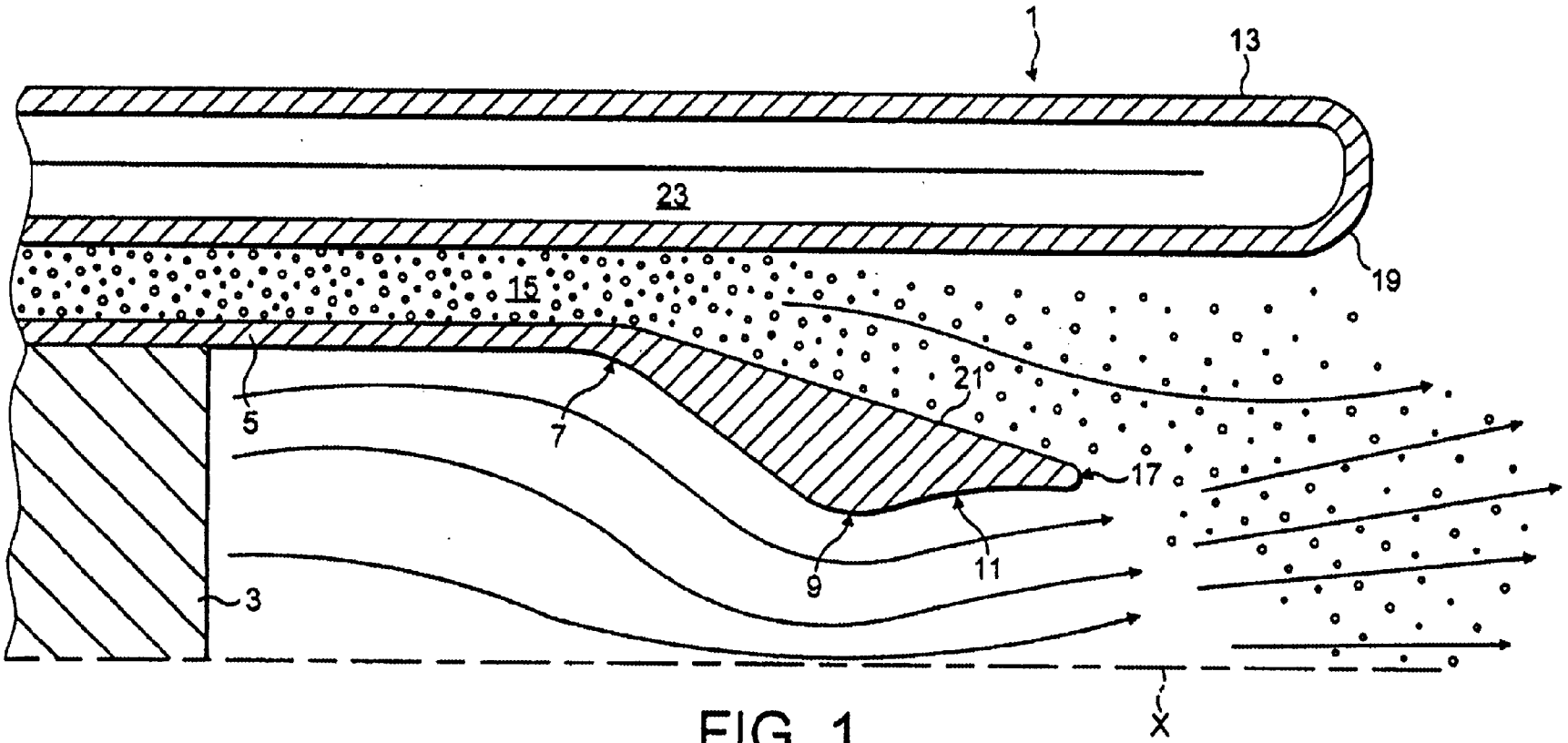
FIG. 1 is a cross sectional view of part of the outlet end of a burner in accordance with a first embodiment of the invention.

FIG. 1 shows, in schematic cross section, the outlet end of a burner 1 (for clarity only part of the burner 1 is shown in FIG. 1; it should be understood that the burner of FIG. 1 is substantially symmetrical about longitudinal axis X).

Burner 1 comprises a "rocket burner" nozzle, of the type well known in the art, shown generally at 3. Nozzle 3 emits natural gas and oxygen, with an oxidant to fuel mol ratio of less than or equal to 2:1, into housing 5. In the direction of flow (to the right in FIG. 1) the flow passage for the mixture of fuel gas and oxygen is radiused at 7, 9 and 11 so as to form a "Laval nozzle", that is a successively convergent and divergent flow path which serves to accelerate the flow of fuel and primary oxidant, and also to enhance mixing thereof. Surrounding housing 5 is a further, outer, housing 13 which defines an annular flow path, or passage, 15 between housing 5 and the inner portion of outer housing 13. Flow passage 15 is provided for the introduction of particulate material into the flow of fuel and primary oxidant. The particular material, which is entrained in air, flows along flow path 15, from left to right in the diagram, until, in the region adjacent the distal end 17 of housing 5 the pressure drop created by the acceleration of the flow of fuel and oxidant the repast draws in the flow of air entrained particulate material, mixing it with the flow of fuel and hence propelling it with the burner flame away from the distal end 19 of burner 1, thereby ensuring that the particulate material is fully distributed within the flame produced by burner 1 and is projected as far as possible into the electric arc furnace (not shown).

A significant feature of the burner 1 of FIG. 1 is that flow path 15 is straight (i.e. there are no curves or obstructions therein). This is important for avoiding erosion of parts of the burner 1 by the particulate material where that material is of a particularly abrasive nature (such as in the case of iron carbide).

The inner housing 5 is preferably water cooled at its distal end (as shown generally by reference 21), and the outer housing 13 is provided with a flow path 23 for cooling purposes (for a flow of cooling water or air).

As will be apparent to those skilled in the art that the air entraining the particulate material flowing from flow path 15 provides a valuable source of secondary oxidant for the combustion process, thereby providing a staged flame which, as is known in the art, helps reduce harmful $NO_x$ emissions.

Figure 2:
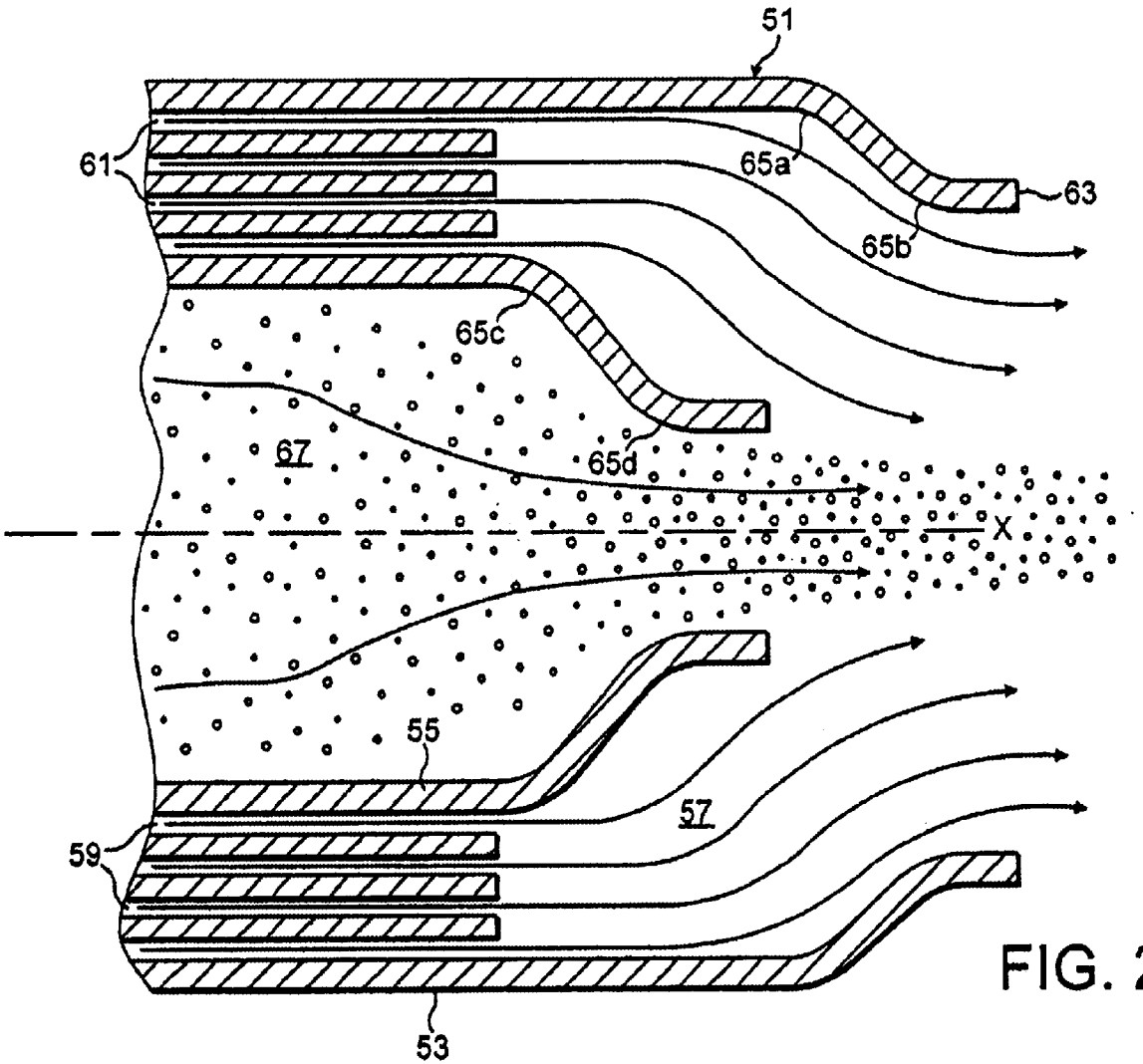
FIG. 2 is a cross sectional view of the outlet end of a second embodiment of a burner in accordance with the invention.

The burner 51 shown in FIG. 2 comprises an outer housing 53 and an inner housing 55 which together provide a successively convergent and divergent flow path 57 in the form of an annulus for the fuel (natural gas) and the oxygen, or oxygen-enriched air supplied via annular channels 59, 61 respectively. The convergent/divergent flow path 57 serves to accelerate the flow of fuel and oxidant to be discharged from the main outlet 63 of burner 51 for subsequent combustion. The housings 53, 55 (which are water cooled) are radiused, respectively, at 65*a*, 65*b* and 65*c*, 65*d* so as to create the successively convergent and divergent flow path 57 from left to right in FIG. 2.

Inner housing 55 also defines a convergent flow path 67 for a supply of particulate material, such as coal, entrained in air, which flow of particulate material is drawn by the reduction in pressure created by the annular flow of accelerating fuel and oxidant mixture emitted from flow path 57 so as to mix thoroughly therewith as the combined flow moves away from the distal end 63 of burner 51. The annulus of accelerating flow of fuel and mixture produced by the burner of FIG. 2 produces a significant drawing effect on the particulate material fed along flow path 67, promoting thorough mixing and projection of the particulate material. This is particularly suitable for introducing a particulate fuel material into the flame.

In the burner 51 shown in FIG. 2, when operated as a coal/air and natural gas/oxygen burner/lance, with an oxygen supply along outlet 61 of about 35 psi or more (about 0.24 MPa or more) with a natural gas supply of greater than 4 MW, and a pressure of about 25 psi or more (about 0.17 MPa or more) a maximum flow rate of greater than 50 kilograms per minute of particulate coal is possible.

Those skilled in the art will appreciate that the burner of FIG. 2 is particularly suitable for introducing a flame into an electric arc furnace at sonic or supersonic speeds but that the particulate flow in flow path 67 may lead to unacceptable abrasion of the inner housing 55 (particularly in the regions shown by references 65*c* and 65*d*), particularly where the particulate material is abrasive. Thus, although suited for use with pulverized or particulate coal, the burner 51 of FIG. 2 may suffer unacceptable abrasion when used with harder particulate materials, such as pulverized coke or particulate char (partially oxidized coal) or iron carbide; the burner shown in FIG. 1 is more suited for use with these types of particulate materials.

Figure 3:
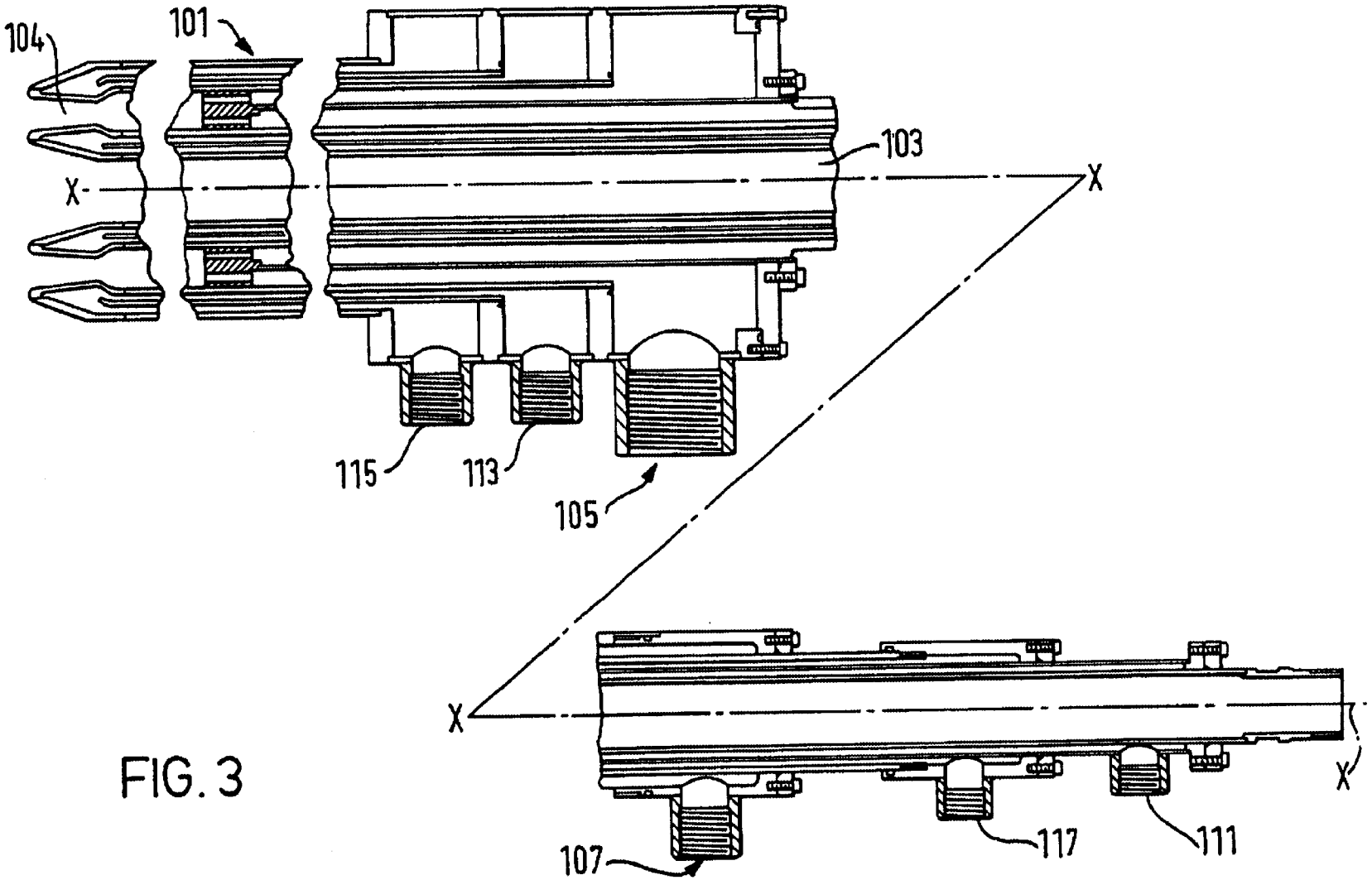
FIG. 3 is a cross sectional view of a third embodiment of a burner in accordance with the invention.

The burner 101 shown in FIG. 3 is very similar to the embodiment of FIG. 2 except that the central, particulate flow path 103 has no curves or restrictions therein, which is particularly desirable when injecting large volumes of particulate material, or particularly abrasive material, or when injecting droplets of liquid or slurries of particulate material in a liquid.

Primary oxidant such as oxygen and gaseous fuel such as natural gas are directed, via inlets 105 and 107 respectively, to mix in convergent/divergent flow path 104, which is in the form of an annulus centered on axis X. Particulate material entrained in secondary oxidant passing along flow path 103 is entrained in the accelerated flow emitted from flow path 103, the particulate material being fully distributed throughout the combustion zone.

The distribution of particulate matter throughout the flame is advantageous as it preheats the particulate material before it enters the furnace. Where the particulate material is coal, preheating can partially or even totally devolatilize the coal particles, the released volatiles serving as fuel for combustion and the remainder consisting mainly of carbon.

The burner 101 of FIG. 3 is provided with water inlets 111, 113 and corresponding water outlets 117, 115 for a flow of water to cool the burner in use.

Figure 4A:
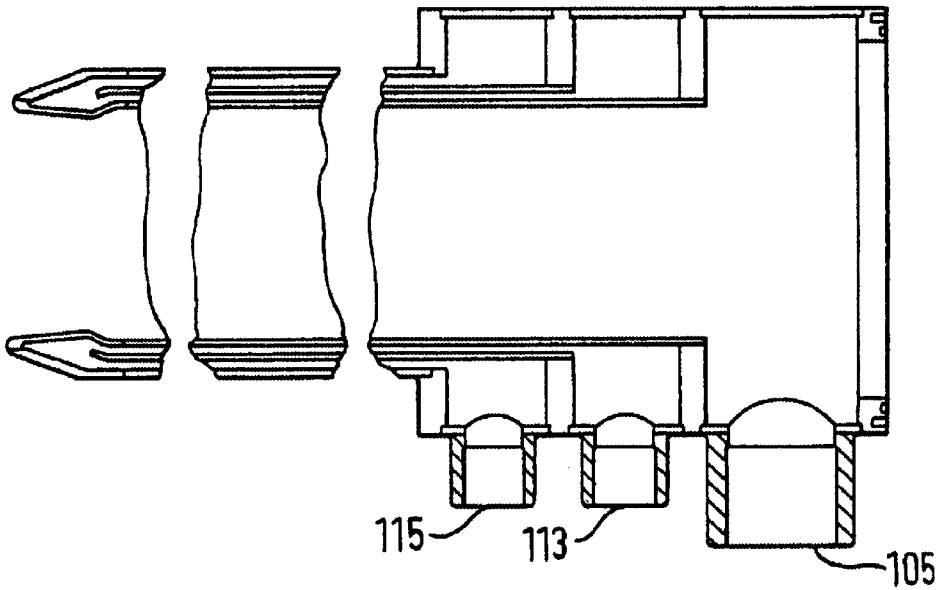
FIGS. 4*a* to 4*d* are cross sectional views of the various elements of the burner of FIG. 3.
Figure 4B:
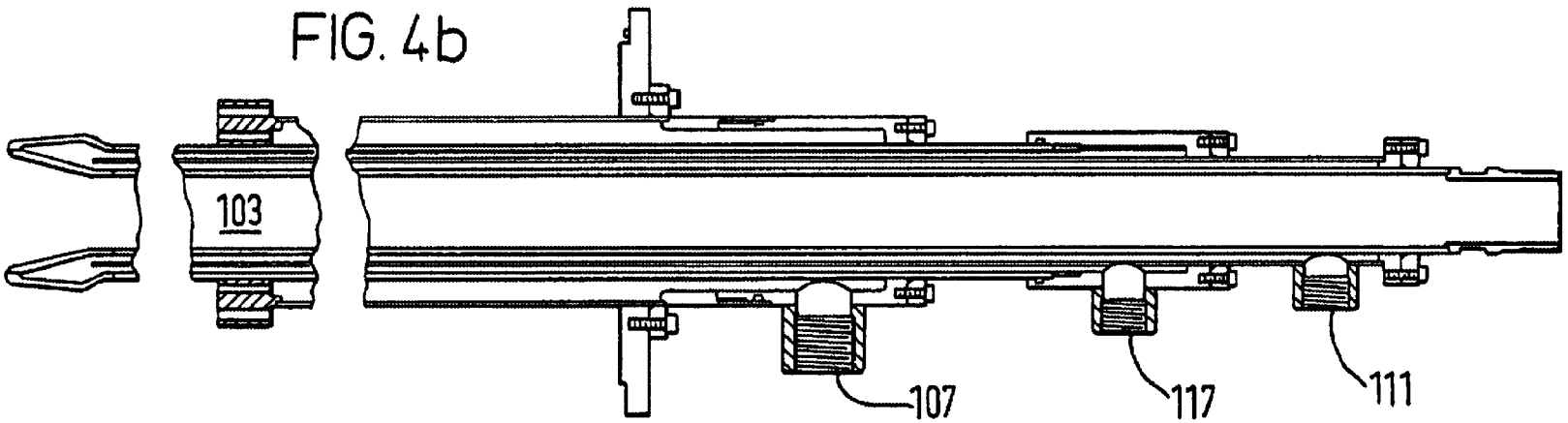
Figure 4C:
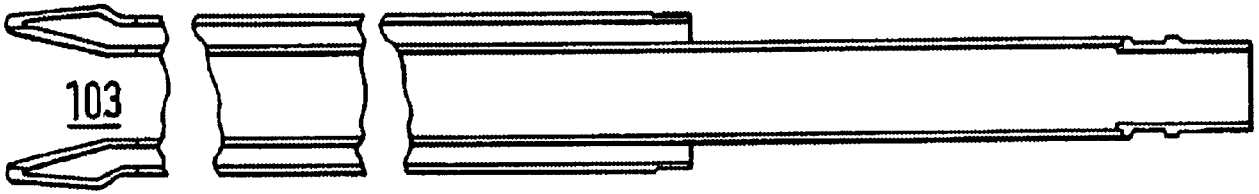
Figure 4D:
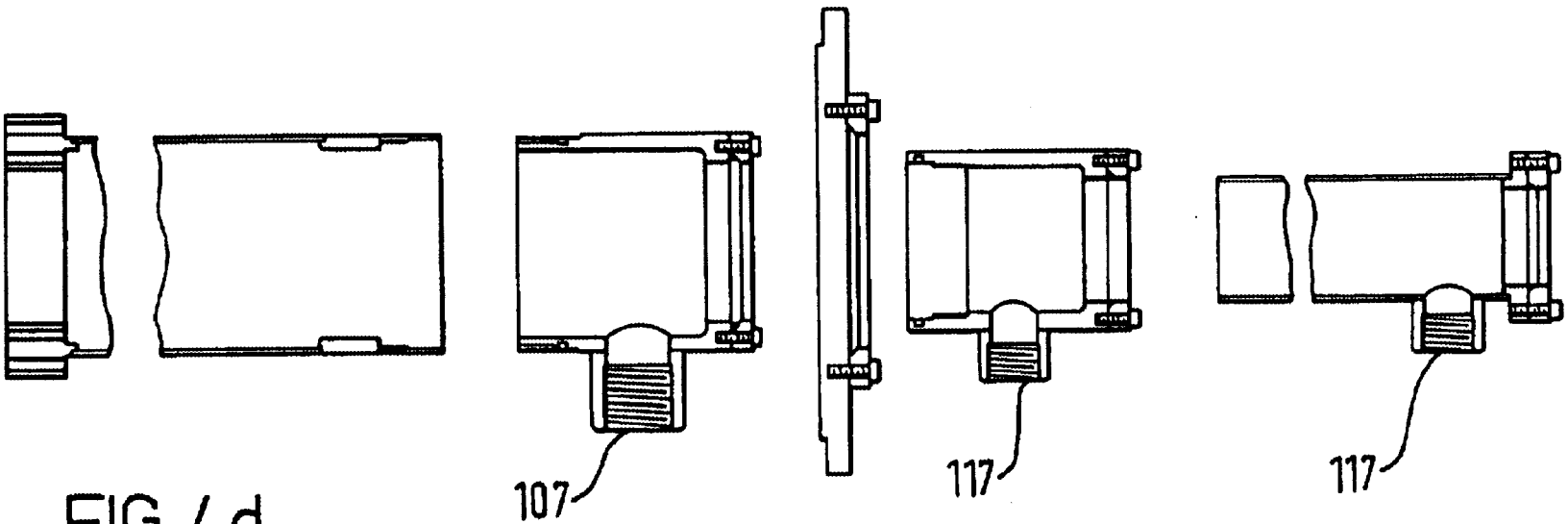

FIGS. 4*a* and 4*b* show the burner of FIG. 3 partly disassembled and FIGS. 4*c* and 4*d* show the sub-assembly of FIG. 4*b* disassembled. As can be seen, the largely axial-symmetric construction illustrated in FIG. 3 allows for quick and easy assembly and disassembly of burner 101, for maintenance and repair or for exchange so as to accommodate different types or flow rates of fuel, oxidant and/or particulate matter.

Although principally described in relation to the injection of particulate coal into an electric arc furnace, burners in accordance with the present invention can be used in many other applications (the injection of non-reactive solid material, such as the preheating of waste dust for reintroduction into an electric arc furnace, for example), and with liquids or slurries, in droplet or atomized form. Burners in accordance with the invention are not restricted to use in electric arc furnaces, but can also be used in incineration, drying and various iron and steel making processes, in cupola furnaces, DRI and iron carbide production.

By supersonic injection of hot oxygen (superstoichiometric flame) it is possible to use the burner for decarburization of the metal as well as post combustion (of carbon monoxide). The burner can be mounted in a water-cooled box. This box can be fitted with an oxygen port or lance for introducing extra oxygen for post combustion while the burner injects hot oxygen and carbon for slag foaming.

As is known to those skilled in the art, the different parts of the burners shown in FIGS. 1, 2 and 3 are configured and dimensioned to take account of such variables as the back pressures available, particle size and desired flow rate, flow rates/velocities to be achieved and the calorific output required from the burner. It will also be understood that the burner of the present invention is not limited to any particular fuel/oxidant ratio; in certain applications it is desirable to provide an oxidant-rich fuel/oxygen mixture ("superstoichiometric running"), such as in post combustion processes, or slag foaming, whereas in other applications it is desirable to provide an oxidant-poor ("substoichiometric") mixture.

I claim:

1. A burner comprising:

a body portion having a longitudinal axis;

the body portion having a main outlet, fuel and primary oxidant outlets upstream of said main outlet and disposed substantially concentrically about the longitudinal axis, a chamber within the body portion for receiving and mixing said fuel and primary oxidant to produce a mixture, means downstream of said chamber for accelerating said mixture of fuel and oxidant towards and out of said main outlet for combustion; and means for discharging particulate matter entrained in a secondary oxidant into the flow of accelerated fuel and primary oxidant immediately adjacent and downstream of said accelerating means, the discharging means being substantially coaxial with the longitudinal axis and the accelerating means being concentrically disposed around the discharging means.

2. The burner as claimed in claim 1 wherein said accelerating means comprises a flow path for the mixture of fuel and primary oxidant, the flow path being successively convergent and divergent in the direction of the flow.

3. The burner as claimed in claim 1 wherein the accelerating means comprises a Laval nozzle substantially coaxial with the longitudinal axis, and said discharging means being disposed concentrically about the longitudinal axis.

4. The burner as claimed in claim 3 wherein the discharging means are configured to discharge said oxidant-entrained particulate matter substantially parallel to the longitudinal axis.

5. The burner as claimed in claim 1 wherein the discharging means is in the form of an annulus surrounding the accelerating means, and is adapted to discharge the oxidant-entrained particulate matter in a hollow, substantially cylindrical or conical, spray pattern.

6. The burner as claimed in claim 1 wherein the accelerating means includes an outlet in the form of an annulus surrounding the discharge means.

7. The burner as claimed in claim 1 wherein the discharging means is shaped and configured to accelerate the oxidant-entrained particulate matter discharged therefrom.

8. A method of operating a burner comprising the steps of accelerating a mixture of fuel and a primary oxidant towards and out of a main outlet of a burner body of the burner for combustion; discharging particulate matter being entrained in a secondary oxidant into said mixture at a position adjacent and downstream to the accelerating flow of fuel and primary oxidant; and drawing said oxidant-entrained particulate matter into the flow of fuel and primary oxidant; wherein the primary oxidant is discharged from the burner at supersonic speed and the particulate matter includes droplets of liquid entraining solid material.

9. The method as claimed in claim 8 wherein the step of discharging the oxidant-entrained particulate matter occurs at at least one outlet located on a circumference of the accelerating flow of fuel and primary oxidant.

10. The method as claimed in claim 9 wherein the step of accelerating comprises accelerating the mixture of fuel and primary oxidant in a hollow, substantially cylindrical or conical, spray pattern, and the step of discharging comprises discharging the oxidant-entrained particulate matter within and substantially coaxial with said spray pattern.

11. The method as claimed in claim 8 wherein the primary oxidant is selected from the group consisting of oxygen and oxygen-enriched air.

12. The method as claimed in claim 8 wherein the secondary oxidant is air.

13. The method as claimed in claim 8 wherein the particulate matter includes liquid droplets.

* * * * *